US011041328B2

(12) United States Patent
Cimpean et al.

(10) Patent No.: US 11,041,328 B2
(45) Date of Patent: Jun. 22, 2021

(54) LATCHING DEVICE FOR A MOTOR VEHICLE

(71) Applicant: Kiekert AG, Heiligenhaus (DE)

(72) Inventors: Octavian Cimpean, Rochester Hills, MI (US); Stelian Borlodan, White Lake, MI (US)

(73) Assignee: Kiekert AG, Heiligenhaus (DE)

( * ) Notice: Subject to any disclaimer, the term of this patent is extended or adjusted under 35 U.S.C. 154(b) by 601 days.

(21) Appl. No.: 15/941,147

(22) Filed: Mar. 30, 2018

(65) Prior Publication Data

US 2019/0301208 A1 Oct. 3, 2019

(51) Int. Cl.
*E05B 77/06* (2014.01)
*E05B 77/04* (2014.01)

(52) U.S. Cl.
CPC ..... *E05B 77/06* (2013.01); *E05B 77/04* (2013.01)

(58) Field of Classification Search
CPC ..... E05B 77/06; E05B 85/26; E05B 77/04; E05B 77/12; E05B 77/02; E05B 77/00; E05B 77/54; E05B 77/245; Y10S 292/22
See application file for complete search history.

(56) References Cited

U.S. PATENT DOCUMENTS 3,799,596 A * 3/1974 Nozomu ..... E05B 77/06 292/216
6,648,380 B1 * 11/2003 Szablewski ..... E05B 81/14 292/201
2014/0284939 A1 * 9/2014 Wittelsbuerger ..... E05B 77/06 292/92
2014/0284941 A1 * 9/2014 Wittelsbuerger ..... E05B 77/06 292/92
2014/0284942 A1 * 9/2014 Wittelsbuerger ..... E05B 85/243 292/92
2014/0284943 A1 * 9/2014 Wittelsbuerger ..... E05B 77/06 292/92
2015/0159408 A1 * 6/2015 Hunt ..... E05B 77/06 292/341.17

(Continued)

FOREIGN PATENT DOCUMENTS

DE 19825708 A1 3/1999
DE 10260900 A1 7/2004

(Continued)

OTHER PUBLICATIONS

International Search Report and Written Opinion dated Jun. 25, 2019 for International Patent Application No. PCT/IB2019/051657.

*Primary Examiner* — Mark A Williams
(74) *Attorney, Agent, or Firm* — Renner, Otto, Boisselle & Sklar, LLP

(57) ABSTRACT

The object of the invention is a latching device (1) for a motor vehicle having a locking mechanism (3) with a catch (6) and at least one pawl (5), a triggering lever (4) whereby the locking mechanism (5) can be unlocked by means of the triggering lever (4), a means to block (11) a movement of the triggering lever (4) arranged on the latching device (1), whereby a blocking of the triggering lever (4) can be attained by a stress (F) acting externally on the vehicle and a shifting movement of the blocking means (11), and whereby the blocking means can be guided back into a starting position dependent on the amount of external stress.

15 Claims, 2 Drawing Sheets

(56) References Cited

U.S. PATENT DOCUMENTS

| | | | | |
|---|---|---|---|---|
| 2015/0308161 | A1* | 10/2015 | Rosales | E05B 77/06 292/195 |
| 2016/0010363 | A1* | 1/2016 | Wahmann | E05B 77/06 292/92 |
| 2016/0069106 | A1* | 3/2016 | Rudraraju | E05B 79/22 292/196 |
| 2016/0076280 | A1* | 3/2016 | Rudraraju | E05B 85/16 292/336.3 |
| 2016/0090758 | A1* | 3/2016 | Bendel | E05B 79/10 292/200 |
| 2016/0168882 | A1* | 6/2016 | Chung | E05B 79/20 292/92 |

FOREIGN PATENT DOCUMENTS

| | | | |
|---|---|---|---|
| DE | 10 2008 021 158 | A1 | 10/2009 |
| DE | 20 2013 002 811 | U1 | 3/2014 |
| EP | 1371799 | A2 | 12/2003 |
| JP | 2017134756 | A1 | 11/2018 |

* cited by examiner

LATCHING DEVICE FOR A MOTOR VEHICLE

FIELD OF INVENTION

The invention relates to a latching device for a motor vehicle, in particular a lateral door latch, having a locking mechanism with a catch and at least one pawl, a triggering lever whereby the locking mechanism can be unlocked by means of the triggering lever, a means to block a movement of the triggering lever arranged on the latching device, whereby a blocking of the triggering lever can be attained by a stress acting externally on the vehicle and a shifting movement of the blocking means.

BACKGROUND

In contemporary motor vehicles a great number of comfort functions play a great role on the one hand and, on the other hand. more and more safety-related functions are integrated into the motor vehicle in order to protect vehicle occupants in an accident, for example. Thus, for example, it must be guaranteed that the doors or flaps do not open independently in the case of accident. Especially in the case of a lateral impact, due to movements caused by inertia or impulses of the external door handles, for example, the latching device assigned to the door may unlock, causing the door to open. Different securing means have become known to secure such movements caused by accidents.

From DE 20 2013 002 811 U1, an accident or crash safety device is known in which a crash element is attached to an engagement area, in particular an external door skin, and whereby the crash element is shiftably accommodated in a crash element accommodation along the lengthwise axis. If a stress impacting on the motor vehicle now occurs, for example, as a result of a collision, the crash element can be shifted with the external door skin in a lengthwise shifting direction in the direction of a latching device. By means of the shifting of the crash element, an operating arrangement can then be blocked to unlock the locking mechanism so that unintentional opening of the locking mechanism can be prevented. However, the disadvantage of such designs of lengthwise shifting crash elements is that the crash element must be aligned very accurately in relation to the latching device as otherwise a shifting of the crash element can occur, the operating arrangement or lever chain cannot engage to trigger the locking mechanism. Thus, although the crash element could be shifted, operation of the lever arrangement cannot be prevented.

A locking and latching device has become known from DE 10 2008 021 158 A1 with which securing of a vehicle door can be ensured in the case of an impact. If, as a result of a stress impacting the motor vehicle, as occurs in a lateral impact, for example, on a lateral door and thus directly on the locking and latching device, for example, the cover surface which is usually made of a thin sheet of metal is dented. A bolting or operating means is pushed against the force of a spiral spring by means of the denting so that a Bowden cable can be blocked.

The class-specific state of the art is formed by the unpublished DE 10 2016 125 167.4. The publication discloses a latching device for a motor vehicle, having a locking mechanism with a catch and at least one pawl, a triggering lever whereby the locking mechanism can be unlocked by means of the triggering lever, a means to block a movement of the triggering lever arranged on the latching device, whereby blocking of the triggering lever can be attained by a stress acting externally on the motor vehicle and a movement of the blocking means can be attained and whereby the blocking means can be shiftably guided in the latching device. The blocking means can be executed as a cylindrical pin and is firmly held by means of a spring element in relation to a latch case of the latching device. By means of a force acting externally on the motor vehicle, the cylindrical pin can be moved into the latching device, whereby the shifting of the cylindrical pin occurs against the force of the spring element and with breaking of a stop surface.

The mentioned state of the art cannot be convincing in all embodiments. The embodiments thus sometimes require a great deal of structural effort or only permit reversing operation of the crash safety device in certain circumstances. This is where the invention is used.

SUMMARY OF INVENTION

The object of the invention is to provide an improved latching device for a motor vehicle. Another task of the invention is to provide improved crash protection with which indirect impingement of the motor vehicle with an impulse can reliably prevent unlocking of the locking mechanism. Another task of the invention is to provide a structurally beneficial and cost-saving solution.

The object is solved by the characteristics of the disclosure. Advantageous embodiments of the inventions are specified in the disclosure. It is pointed out that the exemplary embodiments described hereafter are not restrictive; instead, any possible variations are possible of the characteristics described in the disclosure.

According to patent claim 1, the task of the invention is solved by a latching device for a motor vehicle being provided, having a locking mechanism with a catch and at least one pawl, a triggering lever whereby the locking mechanism can be unlocked by means of the triggering lever, a means to block a movement of the triggering lever arranged on the latching device, whereby a blocking of the triggering lever can be attained by a stress acting externally on the motor vehicle and a shifting movement of the blocking means and whereby the blocking means can be guided back into a starting position dependent on the degree of external stress. Due to the formation of the latching device according to the invention the possibility is now created of preventing blocking of the unlocking of the locking mechanism in the case of an external impulse and simultaneously enabling a reversing movement of the blocking means. The blocking means is guided in the latching device and can be held or guided in relation to the latching device by means of a spring element. Due to the reversibility of the blocking means according to the invention, the blocking means can be repeatedly engaged with the triggering chain of the locking mechanism. This can be advantageous in particular if unlocking of the locking mechanism should be prevented due to a sequence of impulses on the motor vehicle. Furthermore, the reversibility of the blocking means offers the advantage that the latching device is not irreversibly damaged due to the blocking means being guided back.

Different latches or latching devices can be used as a latch for a motor vehicle. The latching device can be used as a compact constructional unit, for example in a lateral door, a sliding door or in the vicinity of flaps or lids or covers. Furthermore, it is also conceivable that hood latches, auxiliary latches such as transporters can be executed with the crash protection according to the invention, for example.

The locking mechanism has a catch and at least one pawl, whereby the catch can be held in a locked position using the pawl. Two-stage locking mechanisms with a pre-ratchet and a main ratchet are used, as are systems with one or two pawls. The movement of the catch is blocked or locked in the ratchet positions by means of the pawl.

A triggering lever acts on the locking mechanism, whereby the triggering lever, for example, by means of a pivoting movement, disengages one or several pawls with the spring bolt. The triggering lever is preferably pivotably accommodated in the motor vehicle latch and preferably in a housing and/or a latch case of the motor vehicle latch or the motor vehicle latching device. A movement of the triggering lever thus leads to the locking mechanism being transferrable from the locked position into an unlocked position.

The movement of the triggering lever can be blocked by means of the blocking means. To this end, the blocking means is shiftable and shiftably accommodated in the latching device, such that a pivoting movement of the triggering lever can be prevented. The locking mechanism remains in the locked position by preventing the triggering lever from moving. It is hereby advantageous for the blocking means to interact directly with the triggering lever. It is therefore advantageous as movements of the internal operating lever and also the external operating lever can occur in the case of accident. The triggering lever preferably interacts with the internal operating lever and the external operating lever. If the movement of the triggering lever is now blocked, neither operation of the internal operating lever and also an external operating lever cannot lead to unwanted opening of the latching device in the case of accident.

In one embodiment of the invention the blocking means can be operated by means of a mass inertia lever. By use of a mass inertia lever to initiate the blocking means, the blocking means can be operated or shifted by an impulse on the motor vehicle if the impulse on the motor vehicle is not directly directed at the latching device itself. This means that in many cases when an accident occurs, direct initiation of an impulse from a direct direction onto the latching system does not occur but that in many cases an impulse is exerted on the latching system which is displaced and not directly directed on the latching system.

If the safety systems known from the state of the art are connected to a direct initiation of the blocking means due to a deformity in the area of the latch system or the latching device, for example, by using a mass inertia lever the blocking means can thus also be operated if a deformity does not occur, for example, of a motor vehicle door in the area of the latching device. Instead, an impulse is also exerted on the blocking means by the mass inertia lever if only a lateral impulse is exerted on the motor vehicle outside of a lateral door, for example. In other words, the latching device according to the invention works independently or can work independently of a deformity of the motor vehicle in the area of a latching system.

The mass inertia lever is advantageously pivotably accommodated in a module carrier. A module carrier is used in motor vehicles and in particular in motor vehicle doors. A module carrier can accommodate different components, such as a disk guide, a closure aid, an operating lever for a latching device and/or also the latching device. However, the latching device is preferably screwed into the chassis itself by means of a latch case. The module carrier itself is preferably made of plastic or a composite material made of metallic materials and plastic, for example.

If the module carrier now continues to be used in a manner according to the invention for accommodation of the mass inertia lever, the number of components required to initiate the blocking means is minimized. Advantageously, the mass inertia lever is pivotably accommodated in the motor vehicle such that by means of an impulse impingement the mass inertia lever can be pivoted in the direction of and onto the blocking means. If an impulse is thus exerted on the motor vehicle, the mass inertia lever thus moves the blocking means into the latching device by means of a pivoting movement so that the triggering chain or the locking mechanism is itself prevented on a final locking of the locking mechanism. The blocking means and the mass inertia lever thus serve as crash protection.

In a further embodiment variant of the invention, an advantage is then attained if in the unoperated state of the blocking means the blocking means can be applied against the installation lever by means of a spring element. The use of a spring element to position the blocking means offers the advantage that safe operation of the blocking means is attained and simultaneously unintentional noises are prevented from the interplay between the blocking means and the mass inertia lever. By means of the spring element the position of the blocking means can thus be secured. The spring element can be formed as a leaf spring or a spiral spring, whereby the spring element preferably encompasses the blocking means, at least in part. On the one hand, the blocking means is moved against the mass inertia lever by means of the spring element and, on the other hand, the blocking means itself can be positioned or held or aligned by means of the spring element in relation to the latching device. A further increase in the security of the functionality of the crash protection can thus be attained.

If the blocking means can be held on the latching device by means of a spring element and can be applied against the mass inertia lever by means of a further spring element, a further embodiment variant of the invention thus results. On the one hand, the blocking means can be aligned by means of a first spring element in relation to the latching device so that a defined guiding of the blocking means can be enabled in relation to the latching device and experiences a force impingement by means of the further spring element which aligns the blocking means in relation to the mass inertia lever. The bisection is advantageous especially to the extent that different spring constants can be combined on the one hand and a lifting movement of the blocking element can be adjusted on the other hand.

If a first spring element consisting of a leaf spring is used, for example, which can be firmly connected to the latching device, a secure positioning and guidance of the blocking means can be attained by the structural configuration of the leaf spring. If the further spring element is executed as a spiral spring or a leg spring, for example, a path for a reversible movement of the blocking means can be adjusted by means of the further spring element. The spring constants of the spring elements can be selected in such a way that, for example in the case of lesser impulse impingement, i.e. a force acts on the motor vehicle which only exerts a small impulse on the mass inertia lever, thus one of the spring elements can be configured in such a way that this spring is firstly deformed so that even small impulses on the motor vehicle can lead to a blocking of the unlocking of the locking mechanism. Thus, for example, only engagement of the blocking means into the triggering chain of the locking mechanism can occur in places, for example. However, advantageously only a spring can also serve to safely guide the blocking means, whereby the further spring cushions the maximum lifting path of the blocking element. Advantageously, by means of a combined configuration of two or more spring elements, a defined guidance and shifting of the blocking means can be attained.

In a further configuration variant of the invention, the further spring element can be formed as a spiral spring, whereby the spiral spring overlaps the blocking means, at least in places. If a spiral spring is used to position the blocking means, the spiral spring can thus advantageously envelop the blocking means, whereby a structurally beneficial embodiment can be attained. A structurally beneficial embodiment results by a small amount of construction space needing to be provided for positioning of the blocking means. Naturally, according to the invention, it is also conceivable to only use one spring element, whereby the blocking means can be held and applied against the mass inertia lever by means of the spring element.

It can also be advantageous if the blocking means is formed as at least two components. A structurally beneficial embodiment can be provided for the blocking means by means of a dual component formation of the blocking means. The formation of stops can be formed in particular so that a defined positional securing can be attained and, on the other hand, the divided embodiment can facilitate installation of the blocking means. In particular, if several spring elements are worked with, a joining in or on the latching device can be facilitated by means of the dual component form of the blocking means on the one hand and on the other hand the lifting movements of the blocking means can be easy to adjust. The blocking means is advantageously constructed of a blocking element and an operating element. The blocking element interacts directly with the triggering chain or the locking mechanism itself, whereby the operating element is engaged with the mass inertia element. Thus, according to the requirements on the blocking means components the materials can be selected for the blocking element and the operating element. A requirement of the blocking element is that secure blocking of the triggering chain should be prevented, whereby materials with a great hardness can be advantageous, for example.

The operating element interacts with the mass inertia lever and especially has the task of transmitting force from the mass inertia lever to the blocking element. Beneficial guidance characteristics can be the focus here when selecting the material. The blocking means is advantageously made of plastic. However, a combination of metallic materials and a plastic or metallic embodiment is also conceivable. Advantageously, a structurally beneficial and cost-effective selection of materials for the blocking means can occur by the division of the blocking means.

If the blocking element and the operating elements can be joined in a form-fitting manner, a further configuration variant of the invention thus results. However, the blocking element is preferably not restrictively executed and/or described as a cylindrical pin. The blocking element acts inside the motor vehicle latch, preferably in the area of the triggering lever or directly in the area of the locking mechanism. Installation of the blocking element directly in the installation of the latching system can be advantageous hereby. The operating element interacts with the mass inertia element and can preferably be arranged outside of the latching system. By means of a form-fitting connection between the blocking element and the operating element, easy installation of the latching system on the module carrier and/or in the motor vehicle itself can thus occur. A form-fitting connection can also be undetachably executed, i.e. for example executed as a clip connection.

A further advantageous embodiment results if the blocking element and/or the operating element have a stop surface. Stop surfaces can act as installation aids but can also facilitate the accommodation of spring elements, for example. Each element of the blocking means advantageously has at least one stop surface. A first stop surface on the blocking element can serve to position the blocking element in relation to the latching device, for example, and interact with a first spring element. A further stop surface on the operating element can serve to hold a spiral spring between the first spring element and the blocking means. Advantageously, a safe and reverse-acting safety system can be provided as crash protection for a latching device by means of the combined and multicomponent construction of the blocking means.

Hereinafter the invention is explained in further detail with reference to the attached drawings on the basis of a preferred embodiment. However, the principle applies that the preferred embodiment does not limit the invention, but only constitutes an advantageous configuration. The characteristics portrayed can be executed individually or in combination with other characteristics of the description and also the patent claims individually or in combination.

BRIEF DESCRIPTION OF DRAWINGS

The following are shown.

DETAILED DESCRIPTION

Figure 1:
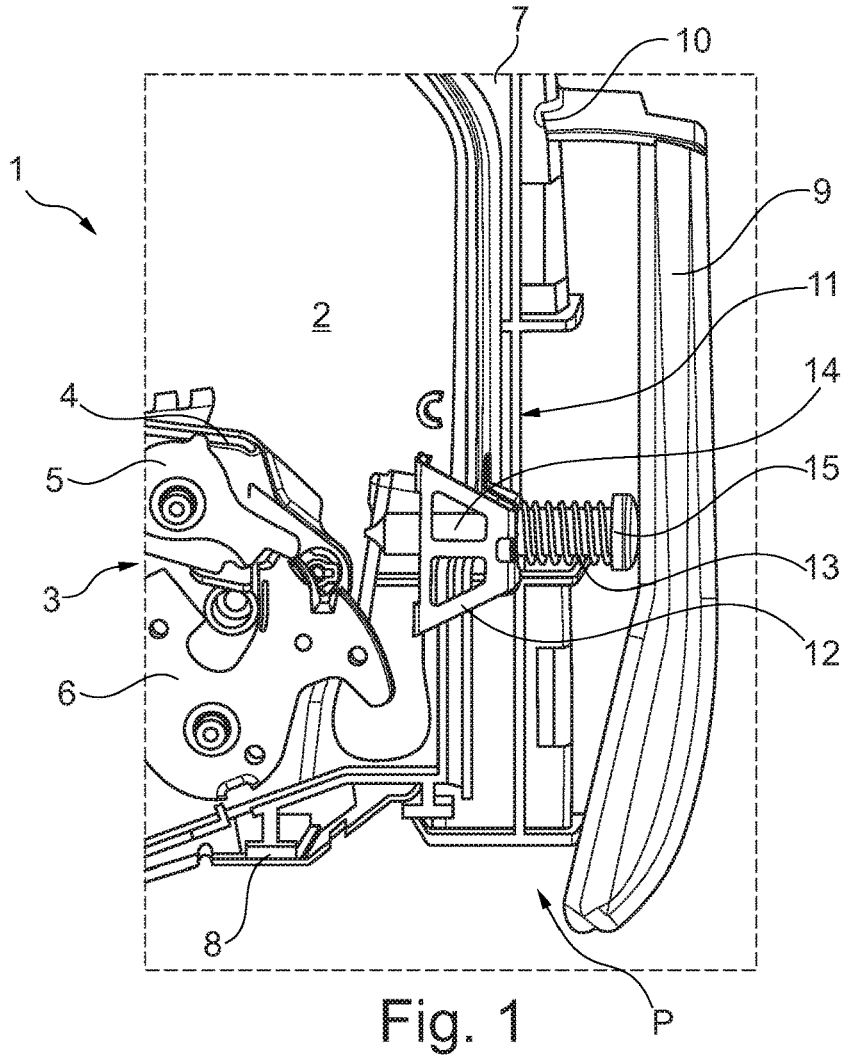
FIG. 1 a lateral view of an opened latching device in the area of a blocking element, with a module carrier and a mass inertia lever, FIG. 2 a detailed view of the opened latching device in the area of the blocking means, whereby the blocking means is reproduced in an operated position, FIG. 3 a representation of the blocking means detached from the latching device, and FIG. 4 an exploded view of the blocking means.

In FIG. 1 a latching device 1 is reproduced as part of a motor vehicle latch and in particular a lateral door latch in a lateral view and in the open position. In the Interior 2 of the motor vehicle latch 1 the locking mechanism 3, pivotably accommodated in the motor vehicle latch 1, and a triggering lever 4 are shown. In this embodiment, the locking mechanism comprises a pawl 5 and a catch 6 which are reproduced in a main ratchet position of the locking mechanism 3.

The latching device 1 is attached to a module carrier 7, whereby a form-fitting connection 8 holds the latching device 1 at least partly in the module carrier 7. Additionally, a mass inertia lever 9 is pivotably accommodated in the module carrier 7. The mass inertia lever 9 is pivotable around a pivoting axis 10 in the direction of the arrow P. Starting from the pivoting axis 7, the mass inertia lever 9 extends along the latching device 1, whereby the mass ratios in the mass inertia lever 9 are formed in such a way that the mass increases along the latching device, starting from the pivoting axis 10.

A blocking means 11 is arranged between the latching device 1 and the mass inertia lever 9, whereby the blocking means 11 is held in the latching device 1 by means of a first leaf spring element 12. A further spring element is formed as a spiral spring 13 in this embodiment, whereby the spiral spring 13 applies the blocking means against the mass inertia lever 9. The blocking means 11 is formed in two components in this embodiment and has a blocking element 14 and an operating element 15.

FIG. 1 illustrates the position of the blocking means 11 in the unoperated state. The blocking element 14 is reproduced at a distance from the locking mechanism 3 or the triggering lever 4 so that the locking mechanism 3 can be unlocked by means of the triggering lever 4.

Figure 2:
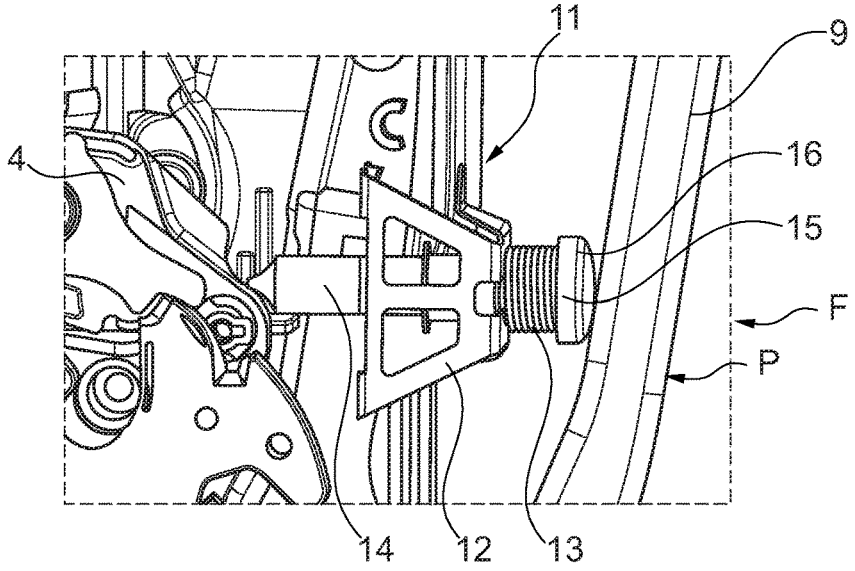

An enlarged illustration of the blocking means 11 is reproduced in FIG. 2, whereby the blocking means 11 is reproduced in an operated position. The mass inertia lever 9 was pivoted in the direction of the arrow P, whereby a contact surface 16 of the operating element 15 was operated by means of an external force F and by means of the mass inertia lever 9. By means of the external force F and by means of the mass inertia lever 9 the spiral spring 13 was compressed, whereby the blocking element 14 engages with the triggering lever 4 by means of the movement of the operating element 15. The leaf spring 12 was not deformed or only slightly deformed so that reversible work of the blocking means 11 can be enabled. If after the impact of the force F on the mass inertia lever 9 the mass inertia lever 9 can be pivoted back into its starting position, the blocking element 14 can thus also be moved back into its starting position, whereby by means of the force of the spiral spring and/or the leaf spring 12 the blocking element 14 and the operating element 15 are moved back into their starting position. The moving back can be accomplished by a form fit between the blocking element 14 and the operating element 15.

Figure 3:
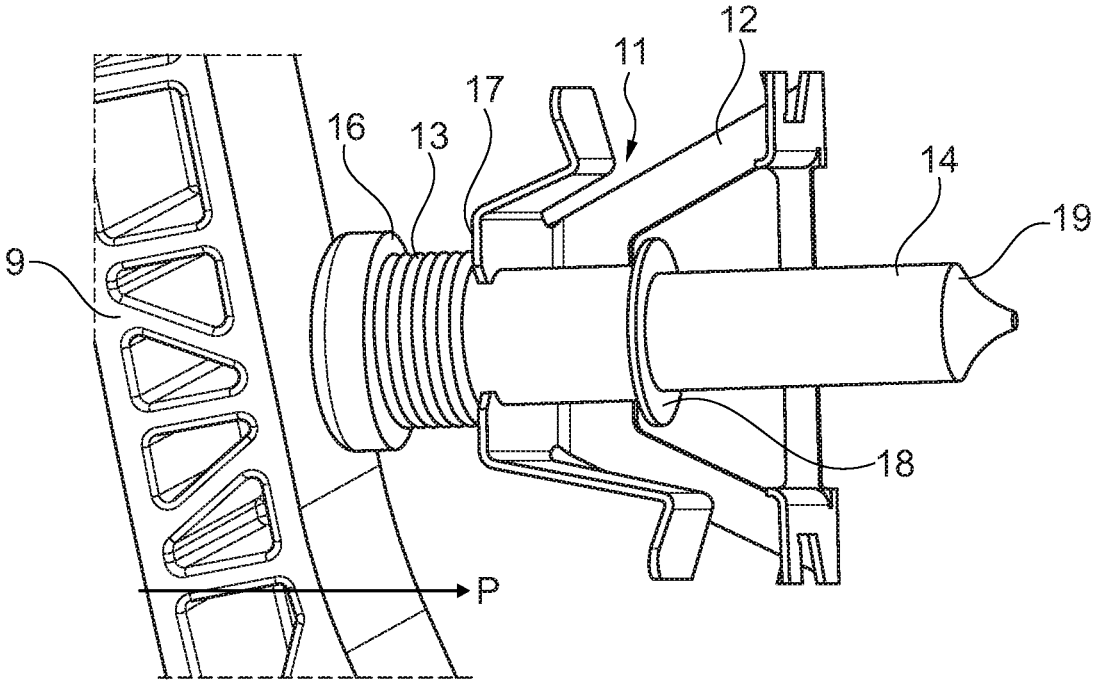

In FIG. 3, the blocking means 11 is reproduced in an enlarged illustration, whereby the state of the engagement of the blocking means into the triggering lever 4 is reproduced. This means that the blocking means 11 is reproduced in the operated position. The mass inertia lever 9 is reproduced in a sectional view, whereby the mass inertia lever is formed as a plastic injection-molded component in this embodiment. The compressed spiral spring 13 is clearly apparent, whereby the spiral spring 13 becomes adjacent between the contact surface 16 and an upper end 17 of the leaf spring 12. The blocking element 14 also has a contact surface 18, whereby the contact surface 18 limits the movement of the blocking means 11 in the direction of the mass inertia lever 9. The blocking element 14 has an engagement contour 19 with which the blocking element 14 engages into the triggering lever 4 in a form-fitting manner.

Starting from the position of the mass inertia lever 9 and the blocking means 11, as their position is reproduced in FIG. 1, for example, by means of an external impulse on the motor vehicle, the mass inertia lever 9 is acted on with a force F, whereby the mass inertia lever 9 is moved in the direction of the arrow P. By means of the movement of the mass inertia lever 9 in the direction of the arrow P the blocking means 11, consisting of the blocking element 14 and the operating element 15 are pushed into the latching device 1, pushed so far into the latching device 1 until the blocking means 11 prevents unlocking of the locking mechanism 3.

Should it be possible for the mass inertia lever 9 to move back into its starting position after the impact of the external impulse or the external force F, the blocking means 11 can also be moved back into its starting position by the force of the springs 12, 13. Only when the mass inertia lever is no longer able to move back into its starting position due to a deformity of the chassis, for example, the blocking means 11 remains in the end position moved into the latching device 1. The amount and nature of the external stress F is thus a crucial criterion for repeatable use of the blocking element 14. In particular in cases where a repeated emergence of impulses F onto the vehicle occurs, the reversible blocking element 14 can be advantageous.

Figure 4:
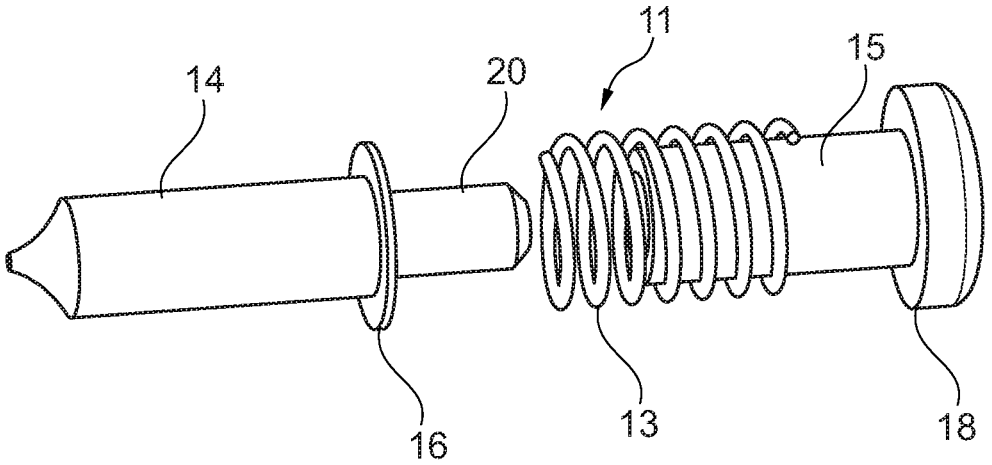

In FIG. 4, the blocking means is reproduced in an exploded view. The blocking element 14 can be inserted into the operating element 15 in this embodiment. A form fit 20 between the blocking element 14 and the operating element 15 can be produced. The blocking element 14 and the operating element 15 can thus be undetachably connected. The spiral spring 13 envelops the operating element 15 fully, whereby the spiral spring 13 becomes adjacent against the contact surface 18. The stop surface 18 thus has a dual function. On the one hand, the contact surface 18 braces the spiral spring 13 and simultaneously acts as a contact surface for the mass inertia lever 9. The contact surface 16 of the blocking element 14 serves to position the blocking means 11. By means of the structure of the blocking means according to the invention, safety inside the vehicle can be increased and a means is provided for reversing blocking or prevention of an unlocking of the locking mechanism 3 in the case of accident.

LIST OF REFERENCE SYMBOLS

1 Latching device
2 Inside of the motor vehicle latch
3 Locking mechanism
4 Triggering lever
5 Pawl
6 Catch
7 Module carrier
8 Form-fitting connection
9 Mass inertia lever
10 Pivoting axis
11 Blocking means
12 Leaf spring
13 Spiral spring
14 Blocking element
15 Operating element
16, 18 Contact surface
17 Upper end
19 Engagement contour
20 Form fit
P Arrow
F Force

The invention claimed is:

1. A latching device for a motor vehicle, the latching device comprising:

a locking mechanism with a catch and at least one pawl;

a triggering lever for unlocking of the locking mechanism;

a blocker provided for blocking a movement of the triggering lever;

a mass inertia lever provided for operating the blocker;

a first spring element that is fixed to a housing of the latching device and configured to hold the blocker within the latching device; and a second spring element for applying the blocker against the mass inertia lever, wherein the second spring element is compressed by the mass inertia lever to enable a shifting movement of the blocker from a starting position to a blocking position for blocking of the triggering lever to prevent unlocking of the locking mechanism when a stress acts externally on the motor vehicle, and wherein the first spring element is undeformed during the shifting movement of the blocker, whereby dependent on an amount of the stress, the blocker can be guided back into the starting position by at least the first spring element.

2. The latching device of claim 1, wherein the mass inertia lever is pivotably accommodated in a module carrier.

3. The latching device of claim 1, wherein the second spring element is a spiral spring, the spiral spring overlapping the blocker at least in parts.

4. The latching device of claim 1, wherein the blocker is formed in at least two components.

5. The latching device of claim 4, wherein the blocker consists of a blocking element and an operating element.

6. The latching device of claim 5, wherein the blocking element and the operating element are form-fittingly joined.

7. The latching device of claim 5, wherein each of the blocking element and the operating element have a contact surface.

8. The latching device of claim 6, wherein each of the blocking element and the operating element have a contact surface.

9. The latching device of claim 1, wherein the first spring element is a leaf spring and the second spring element is a spiral spring.

10. The latching device of claim 7, wherein the second spring element surrounds the operating element and is engageable between the contact surface of the operating element and an end of the first spring element.

11. The latching device of claim 6, wherein the blocking element and the operating element are undetachably joined.

12. The latching device of claim 7, wherein the contact surface of the blocking element engages against the first spring element prior to compression of the second spring element and is disengaged from the first spring element when the second spring element is compressed by the mass inertia lever.

13. The latching device of claim 1, wherein both of the first spring element and the second spring element surround the blocker.

14. The latching device of claim 1, wherein the blocker is elongated in a direction in which the shifting movement of the blocker occurs.

15. The latching device of claim 7, wherein the contact surface of the operating element extends radially outwardly from a longitudinal axis of the operating element.

* * * * *